US008746753B2

(12) United States Patent
Crorey

(10) Patent No.: US 8,746,753 B2
(45) Date of Patent: Jun. 10, 2014

(54) DEVICE AND KIT FOR MAKING KNOTTED STRING ACCESSORIES

(76) Inventor: David J. Crorey, Clinton Township, MI (US)

( * ) Notice: Subject to any disclaimer, the term of this patent is extended or adjusted under 35 U.S.C. 154(b) by 9 days.

(21) Appl. No.: 13/590,803

(22) Filed: Aug. 21, 2012

(65) Prior Publication Data

US 2013/0285375 A1 Oct. 31, 2013

Related U.S. Application Data

(63) Continuation-in-part of application No. 29/419,558, filed on Apr. 30, 2012, now Pat. No. Des. 676,880.

(51) Int. Cl.
*B65H 69/04* (2006.01)

(52) U.S. Cl.
USPC ..... 289/13; 289/17

(58) Field of Classification Search
USPC ..... 289/2, 13, 14, 17, 18.1; 63/43; 223/46; 446/491
See application file for complete search history.

(56) References Cited

U.S. PATENT DOCUMENTS

| | | | | |
|---|---|---|---|---|
| 222,937 | A * | 12/1879 | Newcomb | 66/4 |
| 758,376 | A | 4/1904 | Mees | |
| 1,203,781 | A | 11/1916 | Ratycia | |
| 1,318,465 | A * | 10/1919 | Seifarth | 66/4 |
| 1,318,604 | A * | 10/1919 | Schneider | 66/4 |
| 2,043,082 | A | 6/1936 | Wallach | |
| 2,072,668 | A | 3/1937 | Eltgroth | |
| 2,123,077 | A | 7/1938 | Mayer | |
| 2,129,297 | A | 9/1938 | Zippel | |
| D134,208 | S | 10/1942 | McCrary | |
| D142,530 | S | 10/1945 | Rosenblatt | |
| 2,395,981 | A | 3/1946 | Walker | |
| 2,601,222 | A | 6/1952 | Wehrli | |
| 2,658,364 | A * | 11/1953 | Carlson | 66/4 |
| D204,442 | S | 4/1966 | Brawley et al. | |
| 3,545,069 | A | 12/1970 | Krieger | |
| 3,648,484 | A * | 3/1972 | Gordon | 66/4 |
| 3,650,010 | A | 3/1972 | Powell, Jr. | |
| 3,708,862 | A | 1/1973 | Powell, Jr. | |
| 3,800,372 | A | 4/1974 | Daoust | |
| D238,812 | S | 2/1976 | Fioretti | |
| 4,045,061 | A | 8/1977 | Fierro | |
| 4,103,944 | A | 8/1978 | Alvarado et al. | |

(Continued)

FOREIGN PATENT DOCUMENTS

| | | | |
|---|---|---|---|
| JP | 01256315 | A | 10/1989 |
| WO | 2006053909 | A1 | 5/2006 |

OTHER PUBLICATIONS

Notification of Transmittal, International Search Report and Written Opinion dated Aug. 19, 2010 from International Application No. PCT/US2010/021101.

*Primary Examiner* — Shaun R Hurley
(74) *Attorney, Agent, or Firm* — Young Basile

(57) ABSTRACT

Disclosed herein are embodiments of devices and kits for making knotted string accessories. Embodiments of a device comprise a base that has a substantially planar surface, a perimeter, and a center axis. Furthermore the embodiments include a plurality of holders connected to the substantially planar surface proximate to the perimeter of the base, located at a distance from the center axis, wherein the plurality of holders are configured to retain individual strings. Embodiments of a kit comprise the device, a plurality of strings for use with the device, and storage compartments.

21 Claims, 8 Drawing Sheets

(56) References Cited

U.S. PATENT DOCUMENTS

| | | | | |
|---|---|---|---|---|
| D257,257 | S | 10/1980 | McArthur | |
| 4,260,185 | A | 4/1981 | Shiplee, III | |
| 4,401,329 | A | 8/1983 | Pedroia | |
| 6,119,854 | A | 9/2000 | Prentice et al. | |
| 6,719,013 | B1 | 4/2004 | D'Estais | |
| 6,910,748 | B1 | 6/2005 | Fountain | |
| 7,147,008 | B2 | 12/2006 | Sayler | |
| D563,997 | S | 3/2008 | Gustin | |
| D619,150 | S | 7/2010 | Crorey | |
| D626,574 | S | 11/2010 | Crorey | |
| 7,946,631 | B2 | 5/2011 | Crorey | |
| 8,172,281 | B2 | 5/2012 | Crorey | |
| 2006/0169608 | A1 | 8/2006 | Carnevali | |
| 2010/0218840 | A1* | 9/2010 | Crorey | 139/29 |

* cited by examiner

DEVICE AND KIT FOR MAKING KNOTTED STRING ACCESSORIES

CROSS REFERENCE TO RELATED APPLICATION

This application is a continuation-in-part of U.S. application Ser. No. 29/419,558 filed on Apr. 30, 2012, currently pending and incorporated herein in its entirety.

TECHNICAL FIELD

The embodiments herein relate in general to hand crafted accessories and to devices to assist in the making of knotted string jewelry and accessories.

BACKGROUND

A popular craft project involves making accessories such as bracelets and necklaces by knotting colorful string or plastic. The practice involves many strands of string knotted in a particular pattern to produce the desired product. The process is made easier by keeping the strings separated and somewhat stationary to keep track of the pattern as the product is made. This requires dexterity and can require an uninterrupted time and place in which to craft. Knotted string bracelets have become very popular with adolescents and teens to wear and give to friends. The craft is often done with others, with any minor distraction making it difficult to keep track of the pattern and maintain the strings in the correct positions. In an effort to better manage the strings while crafting, it has been known to use tape to secure the string to a table or the like. A device for providing a simple management system would simplify the craft and make it more enjoyable, particularly for the younger crafters.

BRIEF SUMMARY

Disclosed herein are embodiments of devices for making knotted string accessories from a plurality of individual strings. One embodiment of a device for making knotted string accessories from a plurality of individual strings comprises a base having a substantially planar surface with a perimeter and a center axis extending perpendicular to the planar surface. A plurality of holders is connected to the substantially planar surface. Each of the plurality of holders is located at a first distance from the center axis, wherein the plurality of holders is configured to retain individual strings.

Also disclosed herein are embodiments of kits for making knotted string accessories. One embodiment of a kit for making knotted string accessories comprises a first base having a substantially planar surface with a perimeter and a center axis extending perpendicular to the planar surface and a first plurality of holders connected to the substantially planar surface, each of the first plurality of holders located at a first distance from the center axis and configured to retain individual strings. A first storage compartment is movably attached to the first base and can contain a plurality of the individual strings.

The kit can also comprise a second base having a substantially planar surface with a perimeter and a center axis extending perpendicular to the substantially planar surface, an aperture through which the center axis extends and configured to receive a securing member configured to secure a first end of the plurality of individual strings and a plurality of holders connected to the substantially planar surface located between the perimeter of the second base and the center axis, wherein the plurality of holders are configured to retain individual strings.

In yet another embodiment, a device for making knotted string accessories from a plurality of individual strings comprises a base having a substantially planar surface and a center axis extending perpendicular to the substantially planar surface. A securing member is integral to the base proximate to the center axis and is configured to secure a first end of the plurality of individual strings. A plurality of holders connected to the substantially planar surface is located between a perimeter of the base and the center axis, wherein each of the plurality of holders is configured to retain a respective individual string.

Other embodiments are described in more detail in the detailed description herein.

BRIEF DESCRIPTION OF THE DRAWINGS

The description herein makes reference to the accompanying drawings wherein like reference numerals refer to like parts throughout the several views, and wherein.

DETAILED DESCRIPTION OF THE EMBODIMENTS

Figure 1:
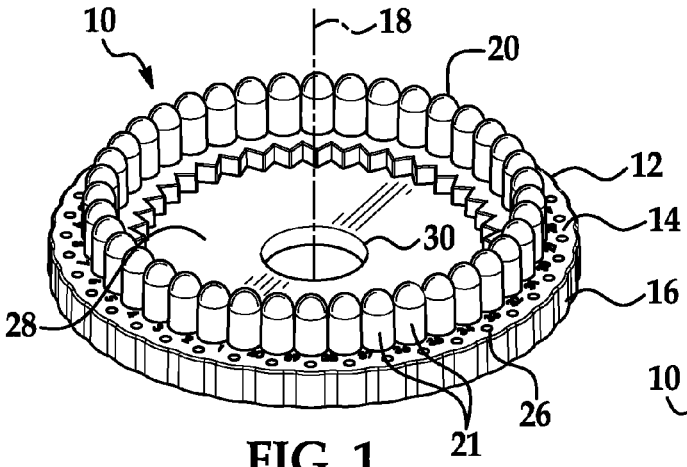
FIG. 1 is a perspective view of an embodiment of a device for making knotted string accessories as disclosed herein.
Figure 2:
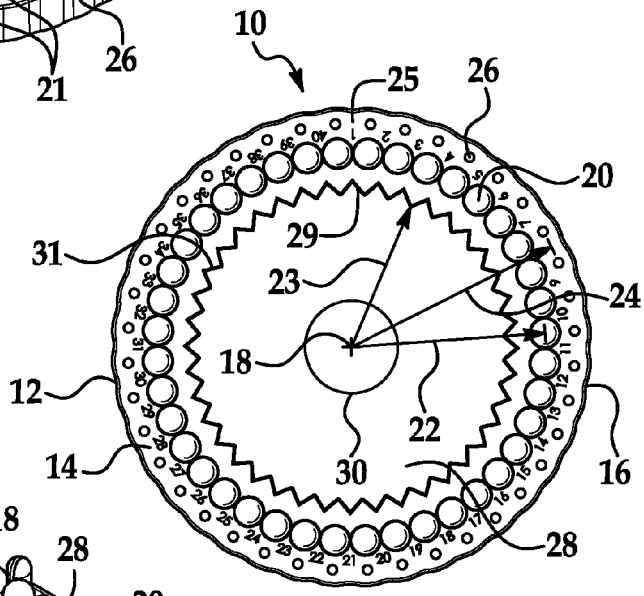
FIG. 2 is a top plan view of an embodiment of the device for making knotted string accessories as disclosed herein.

FIG. 1 is a perspective view of an embodiment of a device for making knotted string accessories. The device 10 for making knotted string accessories from a plurality of individual strings comprises a base 12 having a substantially planar surface 14 with a perimeter 16 and a center axis 18 that extends perpendicular to the substantially planar surface 14. A plurality of holders 20 are connected to the substantially planar surface 14 proximate to the perimeter 16 of the base 12 and spaced equidistantly around the perimeter 16 of the base 12. As shown in FIG. 2, each of the plurality of holders 20 is located at a first distance 22 from the center axis, and the plurality of holders 20 are configured to retain individual strings. The base 12 can have a center aperture 30 through which the center axis 18 extends.

As used herein, "substantially planar surface" means having a two-dimensional characteristic able to position the plurality of holders 20 as required for making the string accessories. The term does not limit the surface to being smooth, as the surface may be textured if desired or required.

The term "strings" as used herein includes any elongated material that can be used with the devices disclosed herein to make bracelets, necklaces, lanyards, belts, and the like. "String" can include embroidery string, thread, yarn, plastic strips for making lanyards, elastic material, and any other material known to those skilled in the art. String can be one or more colors, one or more texture, and one or more material. String can be silk, cotton, plastic, rayon, etc.

The term "knotted" as used herein means any interaction between at least two individual strings that contributes to the pattern of the accessory being made. Other common terms are weaving, tying, braiding, and the like. The methods described below are provided by way of example and are not meant to be limiting. The movement of the strings and order in which they are taken up may be different depending on the pattern being made.

Figure 3:
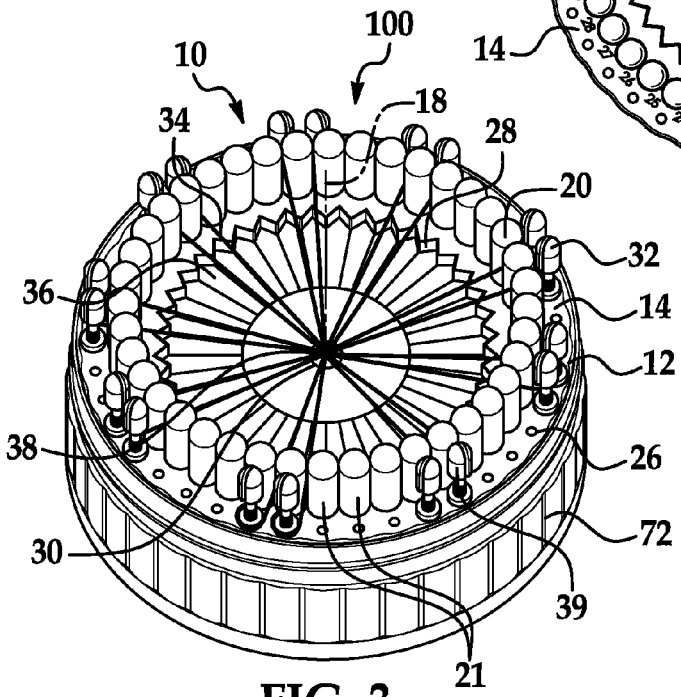
FIG. 3 is the perspective view of a kit for making knotted string accessories showing the initial placement of a plurality of strings in the embodiment of the device disclosed herein.

A plurality of individual strings 34 is used with the device to make the knotted string accessories. FIG. 3 is the perspective view of FIG. 1 showing placement of the plurality of strings 34 in the device 10. In use, a first end 38 of the plurality of strings is gathered and positioned near the center axis 18. There can also be a clip or mounting structure near the center axis 18 to allow the first end 38 to be fixedly attached. The first end 38 of the plurality of strings can be knotted together before positioning near the center axis 18. Each individual string of the plurality of strings 34 can be positioned in one of the plurality of holders 20.

The plurality of holders 20 are configured to retain individual strings, and can be a variety of forms. Non-limiting examples can include clips, holes, knobs, raised portions, and slits. The holders 20 can be made of plastic, rubber, foam, or any other material known to those skilled in the art. In one embodiment shown in FIGS. 1-3, the plurality of holders 20 comprise a plurality of raised portions 21. A total of 40 raised portions are shown in FIGS. 1-3. This is provided by way of example, and any desired number of raised portions can be used. In this embodiment, each individual string of the plurality of strings 34 can be retained between adjacent raised portions 21 of the plurality of holders 20 such that the strings are sufficiently taut. As shown in FIG. 3, 16 individual strings are used. This is provided by way of example and is not meant to be limiting. Any number of strings can be used as desired or required based on individual preference or the requirements of a pattern.

The plurality of raised portions 21 can include a retainer mechanism between adjacent raised portions 21 configured to retain the individual strings. The retaining mechanism can be as simple as the compressive force between the adjacent raised portions 21, particularly if elastic material is used for the raised portions. The retaining mechanism can be, for example, a slit made in one of the adjacent raised portions 21. The individual string can be placed in the slit and tightly gripped by the surrounding raised portion. Pieces of elastic material can be placed between the adjacent raised portions to elastically compress the string. Adjacent raised portions can be coated with an elastic material like rubber to hold the strings there between.

Figure 5:
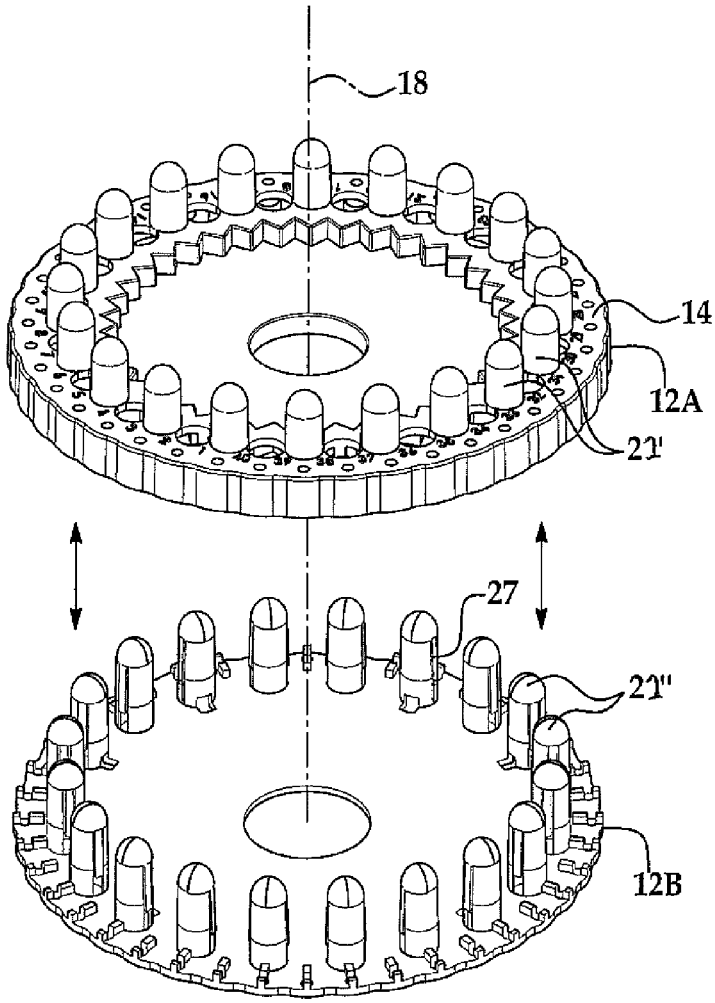
FIG. 5 is an exploded perspective view of the device for making knotted string accessories shown in FIG. 1.

In FIG. 5, an embodiment of the base 12 is shown in an expanded view. In this embodiment, the base 12 of the device 10 is manufactured in two pieces. A first piece 12A is shown integral with the planar surface 14. However, it can be a separate piece attached to the planar surface 14 if desired. The first piece 12A provides every other raised portion 21' when the plurality of holders 20 comprises a plurality of raised portions 21. The second piece 12B, providing the alternate raised portions 21", is configured to fit under the first piece 12A. Side springs 27 can be integrally formed in each of these raised portions 21" on opposing sides. The first piece 12A has apertures between the raised portions 21' through which the raised portions 21" of the first piece 12A extend. Once extended, the side springs 27 expand toward the raised portions 21' of the first piece 12A, thereby creating a retainer mechanism between adjacent raised portions 21' and 21" that is configured to retain the individual string.

Figure 6:
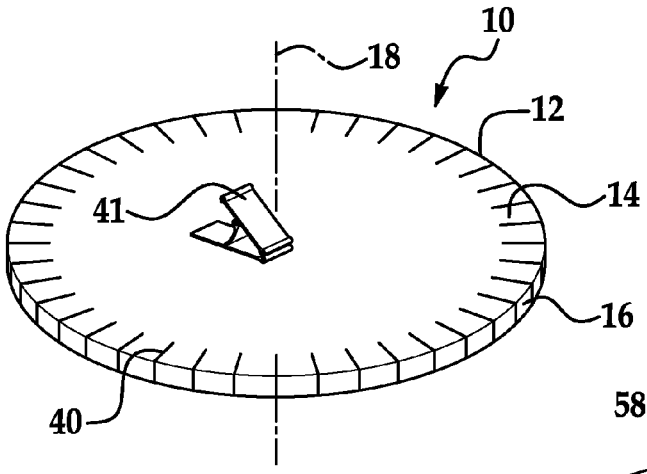
FIG. 6 is a perspective view of another embodiment of a device for making knotted string accessories.

In another aspect of the device 10, the plurality of holders 20 can comprise a plurality of slits 40 defined in the base 12 at the perimeter 16, as shown in FIG. 6. Each of the plurality of slits 40 can be configured to retain individual strings, with the portion of the planar surface between slits 40 acting as the raised portions 21.

The first end 38 of the plurality of strings 34 can be held substantially stationary near the center axis 18 by the tension on the individual strings held in the plurality of holders 20 located near the perimeter of the base 12. Furthermore, there can be a center aperture 30 in the base 12 to receive the first end 38, as shown in FIG. 2. Alternatively, as shown in FIG. 6, the device 10 can include a clip 41 attached to the substantially planar surface 14 of the base 12 near the center axis 18. The clip 41 can releasably retain the first end 38 of the plurality of strings 34. The clip can be any shape and size such that the first end 38 of the plurality of strings 34 can be held stationary near the center axis 18. The clip 41 can have a spring configured to bias the clip 41 to secure the first end of the plurality of individual strings. When force is placed on the spring, the clip will open to receive the string. With the force removed, the spring returns the clip to the closed position, securely retaining the string. The clip 41 can be any shape as desired or required. For example, the clip 41 could be in the shape of a butterfly, flower, peace sign, animal, star, etc. in an effort to make the device more aesthetically pleasing.

Figure 4:
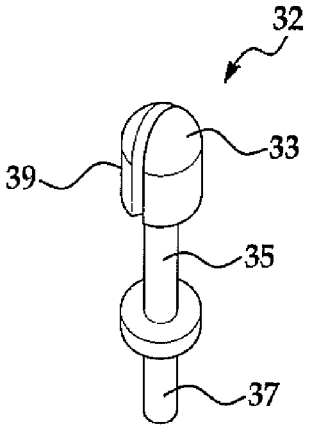
FIG. 4 is a perspective view of a positioning member configured to manage an individual string.

Embodiments of the device 10 can further include positioning members 32, shown in FIG. 4, with each of the positioning members 32 being configured to attach to an individual string. The positioning members 32 can be removably attached to the base 12 to assist the user in moving individual strings of the plurality of strings 34 from different positions relative to the plurality of holders 20. The positioning members 32 can be attached to the base 12 at a second distance 24 from the center axis 18, where the second distance 24 is greater than the first distance 22. The positioning members 32 of one embodiment are spindles 39 configured such that individual strings can be wrapped around and secured on the spindle 39, as shown in FIG. 3. Referring to FIG. 4, each spindle 39 has a first end 33 configured with a slit to receive a free end of an individual string. Spindles 39 also include a middle section 35 configured to allow an individual string to be wrapped around the spindle. Finally, the spindle 39 has a second end 37 configured to attach to the base 12 and sized to fit into positioning apertures 26 located at the second distance 24 from the center axis 18.

Figure 14:
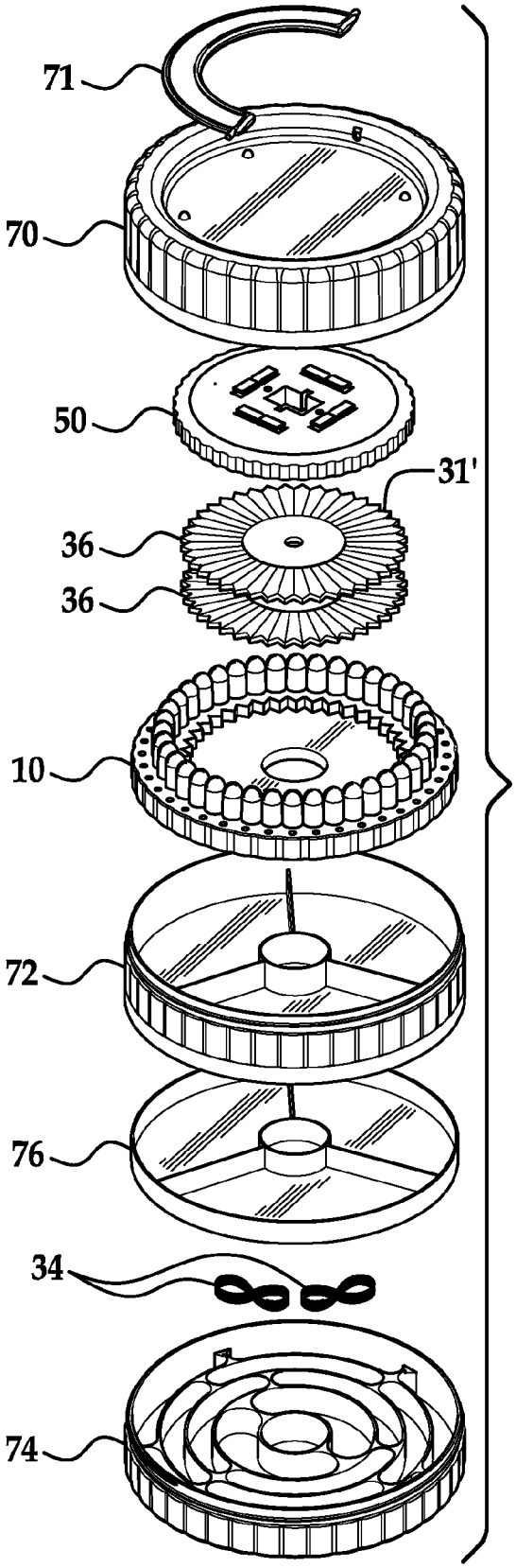
FIG. 14 is an exploded view of a kit as disclosed herein.

The device 10 can be configured to include a pattern template 36 to assist in the creating of knotted string accessories, as better seen in FIG. 14. The pattern template 36 can be permanently incorporated on the substantially planar surface 14 of base 12, or the base 12 can be configured to receive a variety of removable pattern templates. In one embodiment displayed in FIGS. 1-3, there is a recess 28 formed in the substantially planar surface 14 of the base 12 to allow the positioning of a pattern template 36. The recess 28 is defined with an outer edge 29 that is at a third distance 23 from the center axis 18, where the third distance 23 is less than the first distance 22 of the plurality of holders 20 from the center axis 18. The outer edge 29 is formed with teeth 31, with a corresponding pattern 31' on the perimeter of the pattern template 36 (shown in FIG. 14). The teeth 31 prevent movement of the pattern template 36 when in use on the base 12. The teeth 31 are provided by means of example and are not meant to be limiting. Other patterns or means to prevent movement can be used. The pattern template 36 can include number and color indications to assist a user in the initial setup of the strings, as well as the correct procedure in creating a specifically designed accessory.

Embodiments of the base 12 disclosed herein can have base indicia 25 on the substantially planar surface 14 located near the plurality of holders 20. Base indicia 25 can by numerals, letters, symbols, or any other form that would help a user in orientating the device 10. As shown in FIG. 2, the indicia can comprise numbers in series and equal to the number of raised portions. The pattern template 36 can have similar indications to allow the user to position the pattern template 36 with a particular orientation with respect to the base 12. The base indicia can be used to assist in the making of the accessory or assist in instructing a user how to use the device. Other indicia are contemplated as desired or required.

To make the knotted string accessory, the typical method is to select a pattern template 36 and the amount of strings and color of strings desired or required for the pattern template 36. A knot is tied in the middle of the strings, producing a loop. The individual strings are then placed in the plurality of holders 20 in accordance with the pattern template 36. Individual strings are moved from positions in the plurality of holders 20 such that the movement of the strings produces knots to form in the plurality of strings 34. This is continued until the bracelet formed by the knotting of the strings is the desired length.

A kit 100 for making knotted accessories is shown in FIG. 3. The kit 100 can comprise embodiments of the device 10 and a plurality of strings 34, which can be stored in a storage compartment 72 underneath the base 12. The storage compartment 72 can attach to the base with threads, as a non-limiting example. A lid can also be included.

Figure 7A:
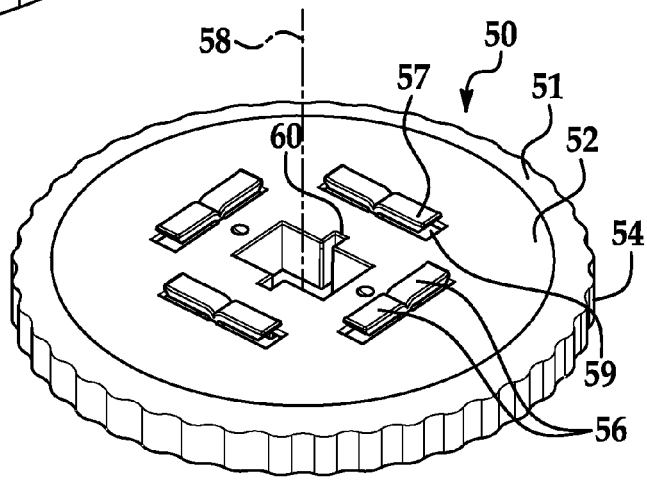
FIG. 7A is a perspective view of another embodiment of a device for making knotted string accessories as disclosed herein.
Figure 7B:
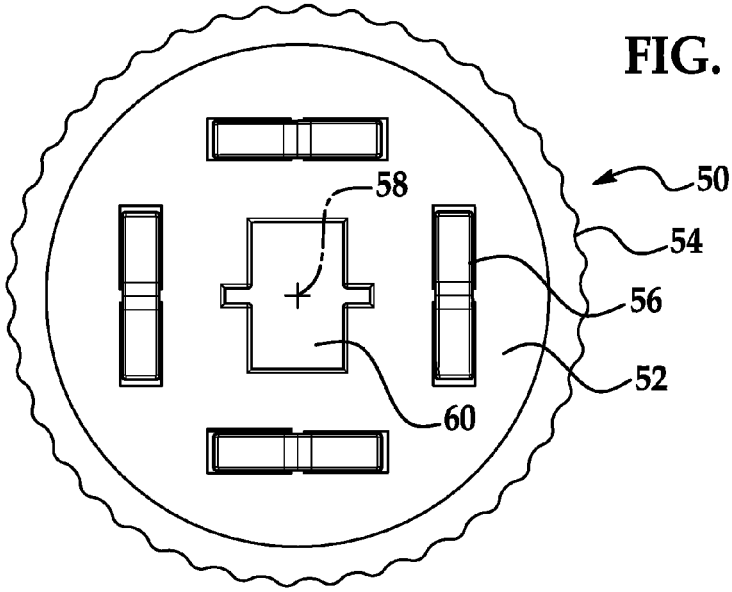
FIG. 7B is a top plan view of the embodiment shown in FIG. 7B.

Another embodiment of a device 50 for creating knotted string accessories is depicted in FIGS. 7A-7B. The device 50 can comprise a base 51 having a substantially planar surface 52 with a perimeter 54 and a center axis 58 that extends perpendicular to the substantially planar surface 52. The device 50 further comprises a securing mechanism 60 integral to the base 51 proximate to the center axis 58 and configured to secure a first end of a second plurality of individual strings. A plurality of holders 56 is located on the substantially planar surface 52 of the base 51, the holders being configured to retain individual strings.

Figure 7C:
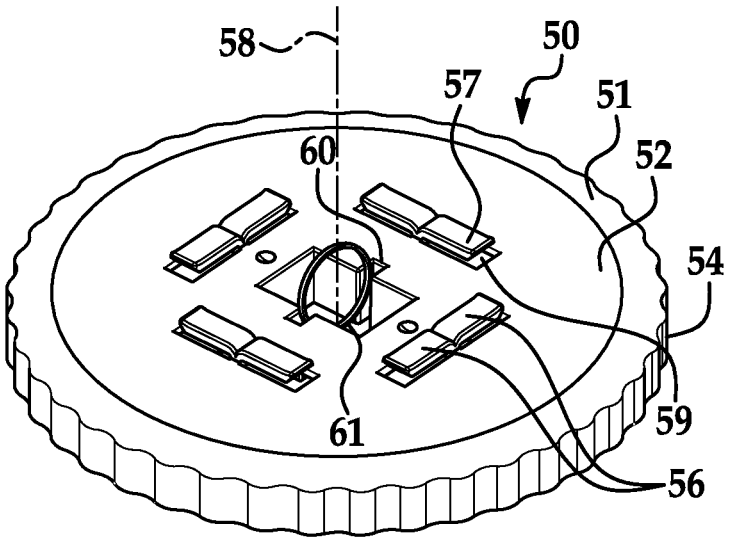
FIG. 7C is a perspective view of the embodiment of FIGS. 7A and 7B with a key ring.

The securing mechanism 60 can be an aperture defined in the base 51 described in more detail below. The securing mechanism 60 can also be a hook, a clasp, a pin, or other means of securing the first end of the plurality of strings. The securing mechanism 60 can also be any raised member configured to receive and maintain a loop. As shown in FIGS. 7A-7C, the securing mechanism 60 can be an aperture in the base 51 sized to hold a key ring 61. The first end of the plurality of strings can be tied or otherwise attached to the key ring 61, which can be located in the securing mechanism 60 while the user creates the knotted string accessory.

The plurality of holders 56 of the device 50 can comprise eight holders as shown in FIGS. 7A-7C. Furthermore, the plurality of holders 56 can be a plurality of raised portions. The raised portions can be configured to retain an individual string. The raised portions in FIGS. 7A-7C are shown as clips. Each of the clips can include a clip portion 57 that is offset from the substantially planar surface 52, and overlaying a clip aperture 59 defined in the substantially planar surface 52. Individual strings can then be held in position between the clip portion 57 and the substantially planar surface 52. The clips can be located at an equal distance from the center axis 58, or positioned in different locations between the center axis 58 and perimeter 54.

The kit 100 can comprise one or more of the embodiments of the devices 10 and 50. In one embodiment of shown in FIG. 8 for use in a kit as disclosed herein, the embodiment of the device 50 is configured to overlay the substantially planar surface 14 of the embodiment of device 10 within the holders 20 of device 10. The embodiment of device 50 can be stored in this position, and can also be used in this position as the surface 52 of device 50 is raised sufficiently so that the holders 20 of device 10 will not be in the way. The perimeter 54 if device 50 can have a pattern that corresponds to the pattern formed by the holders 20 of device 10, so that when device 50 is positioned on device 10, the device 50 will not rotate within base 10, making device 50 easier to use.

Figure 8:
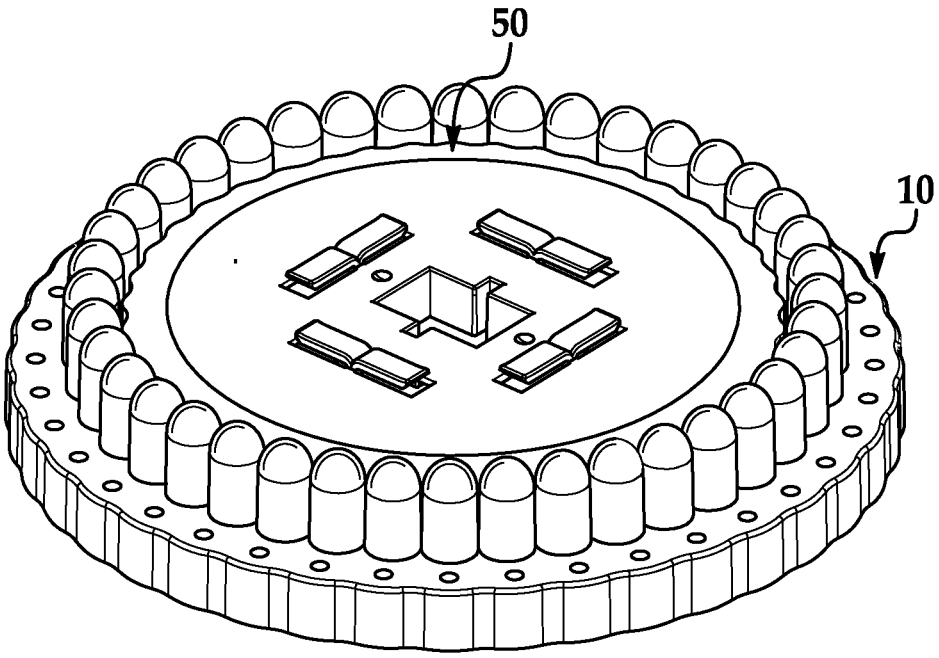
FIG. 8 is a perspective view of an embodiment of a kit for making knotted string accessories.
Figure 9:
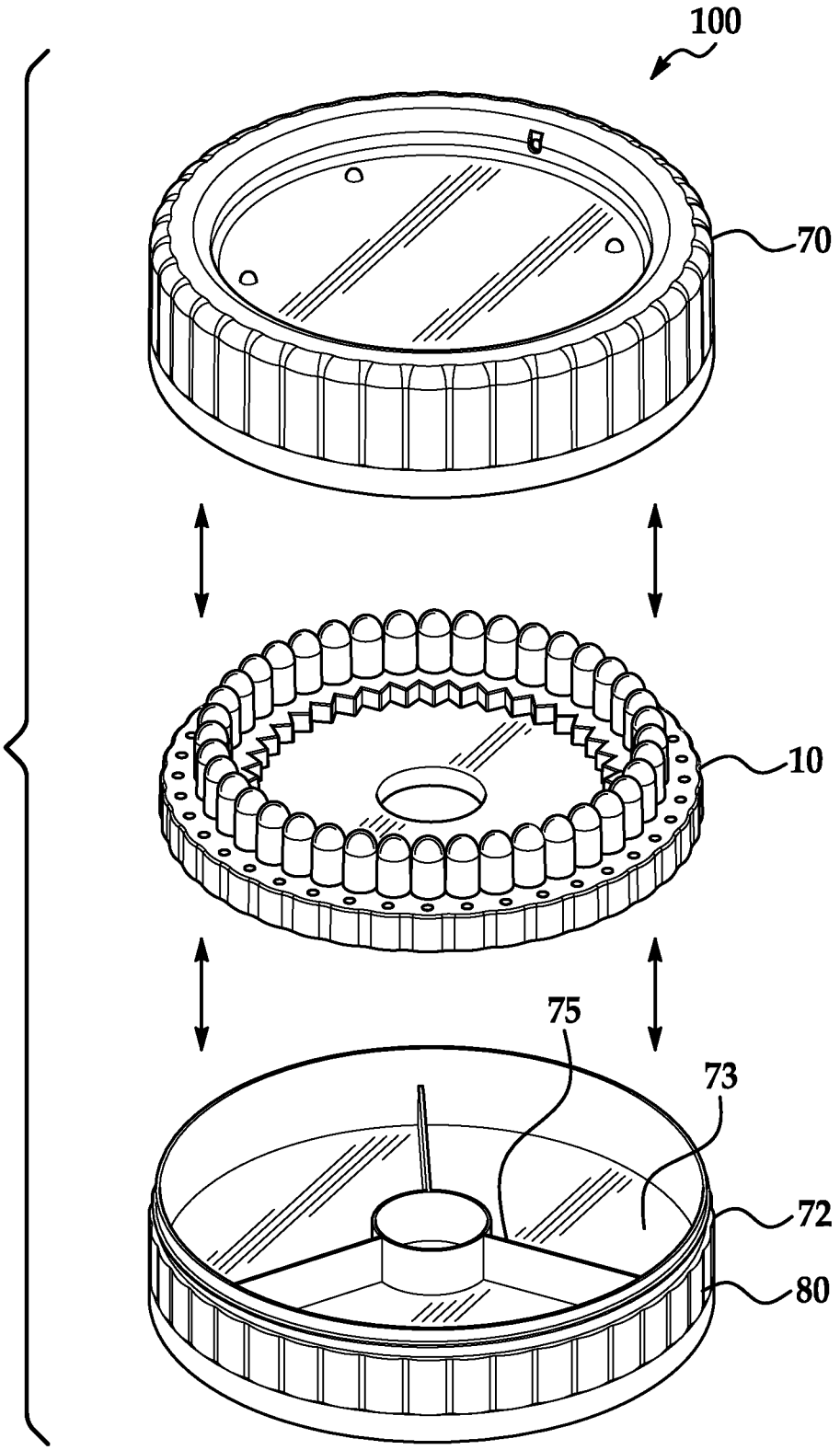
FIG. 9 is an exploded view of an embodiment of a kit with a lid, device, and a first storage compartment.

Another aspect of the kit 100 of FIG. 8 is shown in FIG. 9. The kit 100 can include the first storage compartment 72, the device 10, and a lid 70. The lid 70 can be configured to be removably attached to the first storage compartment 72. As a non-limiting example in FIG. 9, the lid is removably attached to the first storage compartment 72 via a threaded connection 80. The first storage compartment 72 can have at least one inner cavity 73, and can include a divider 75. The inner cavities can be any shape desired or required. The first storage compartment 72 can store anything that is sized to be retained in the inner cavities 73. However, it is contemplated that different strings, beads, gems, instructions, pattern templates, etc. will be stored in the inner cavities 73. Furthermore, the first storage compartment 72 can be configured to hold one or more devices 10, 50 when the lid 70 is attached to the first storage compartment 72.

Figure 10:
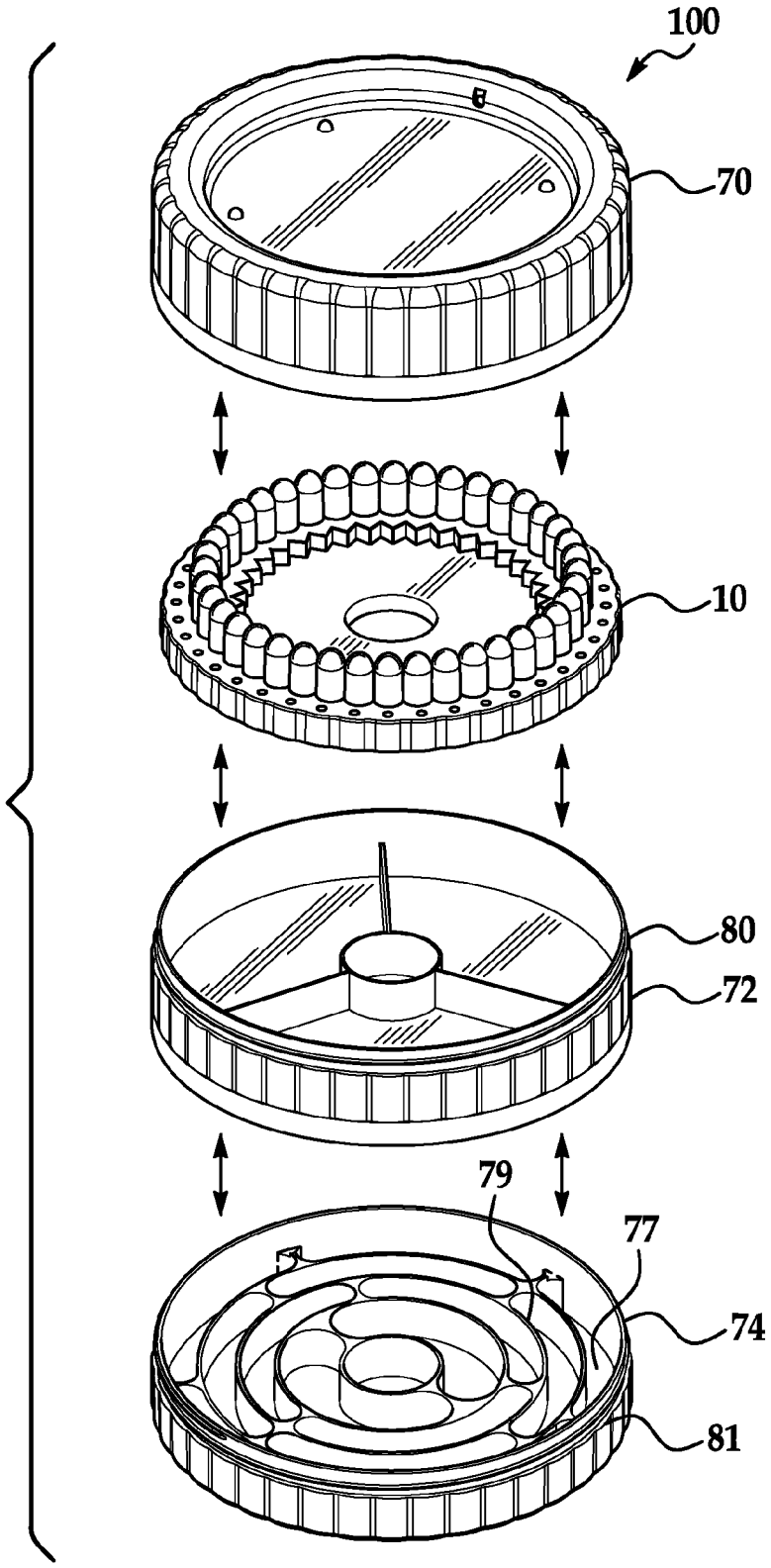
FIG. 10 is an exploded view of an embodiment of a kit with a lid, device, a first storage compartment, and a second storage compartment.
Figure 11:
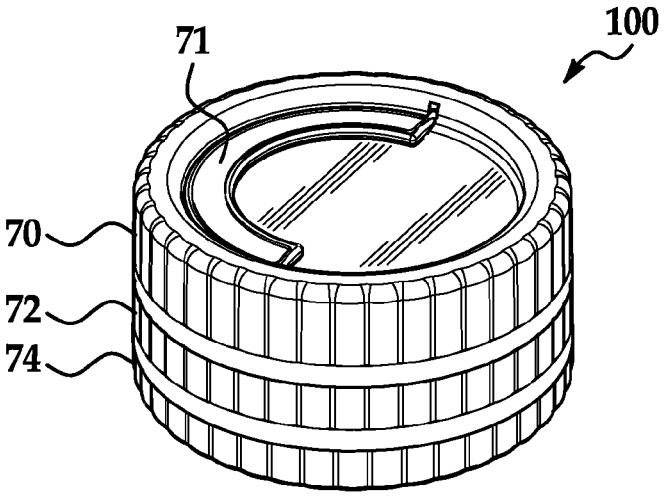
FIG. 11 is a perspective view of an embodiment of a kit as disclosed herein.
Figure 12:
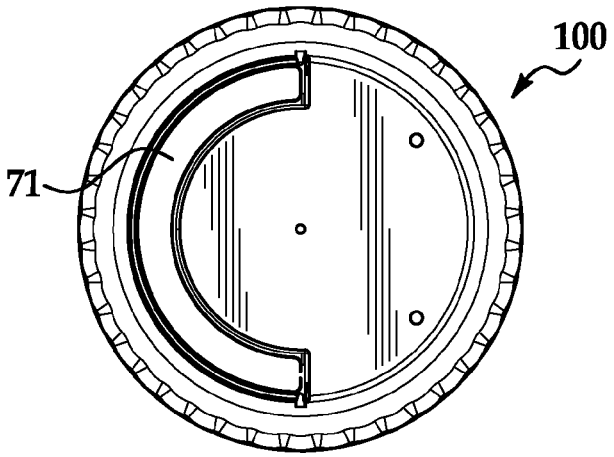
FIG. 12 is a top plan view of an embodiment of a kit as disclosed herein.
Figure 13:
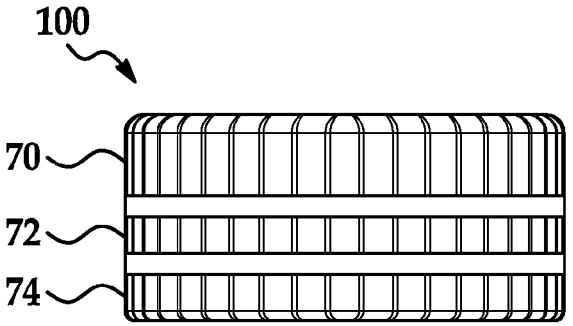
FIG. 13 is a side view of an embodiment of a kit as disclosed herein.

Referring now to FIG. 10, another embodiment of kit 100 can include the lid 70, the first storage compartment 72, and a second storage compartment 74. The second storage compartment 74 can have at least one cavity 77, and divider 79. Similar to the first storage compartment, the second storage compartment 74 can store anything that is sized to be retained in the at least one cavity 77. The second storage compartment 74 can be removably connected to the first storage compartment 72 via a second threaded connection 81.

In yet another embodiment of kit 100, a storage tray 76 can be included, where the storage tray 76 is configured to fit inside the cavity of the second storage compartment 74, as shown in FIG. 14.

FIGS. 11-14 show different views of an embodiment of kit 100 which includes: lid 70, handle 71, device 50, device 10, first storage compartment 72, tray 76, second storage compartment 74, a plurality of strings 34, and at least one pattern template 36. It is contemplated that in this embodiment, the storage tray 76 fits into the second storage compartment 74, and the device 10 and device 50 fit into the first storage compartment 72. The plurality of string 34 and pattern templates 36 can fit into at least one of the first or second storage compartment cavities. The lid can be attached to the first storage compartment, and one can carry the kit with the handle 71. Any combination is contemplated herein.

The other embodiments of the device 10 or device 50 discussed above can all be incorporated into the kit 100 as desired or required.

Embodiments of the device disclosed herein can be made from plastic, foam, rubber, metal, resin and combinations thereof. Any material known to those skilled in the art that will provide the strength and rigidity necessary to function as desired or required can be used. Elements of the device can be molded individually and assembled or more than one element of the device can be molded together to reduce the number of parts for assembly.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for making knotted string accessories from a plurality of individual strings comprising:

a base having a substantially planar surface with a perimeter and a center axis extending perpendicular to the planar surface; and a plurality of holders connected to the substantially planar surface, each of the plurality of holders located proximate to the perimeter of the base and spaced equidistantly around the perimeter of the base, wherein the plurality of holders are a plurality of raised portions extending outward from the substantially planar surface parallel to the center axis in close proximity to one another, wherein adjacent raised portions are configured to retain individual strings.

2. The device of claim 1 further comprising:

positioning members each configured to attach to an individual string and removably attach to the base proximate to a respective one of the plurality of holders between the respective one of the plurality of holders and the perimeter of the base.

3. The device of claim 2, wherein each of the positioning members is sized to fit in a plurality of apertures defined in the substantially planar surface of the base.

4. The device of claim 1, wherein the plurality of raised portions includes a retainer mechanism between adjacent raised portions configured to more tightly retain the individual string.

5. The device of claim 1, further comprising:

a recess provided in the substantially planar surface of the base configured to receive pattern templates, wherein an outer edge of the recess is positioned between the center axis and the plurality of holders.

6. The device of claim 1, wherein the substantially planar surface of the base comprises indicia proximate the plurality of holders to sequence the plurality of holders.

7. The device of claim 1, wherein the base further comprises a center aperture through which the center axis extends, the center aperture configured to receive a first end of a plurality of strings.

8. The device of claim 7, wherein the center aperture is configured to retain a key ring and the plurality of holders connected to the substantially planar surface are equidistantly located between the perimeter of the base and the center axis.

9. The device of claim 8, wherein the plurality of holders are clips, each clip configured to retain an individual string.

10. The device of claim 1 further comprising:

a securing member carried by the base proximate to the center axis and configured to secure a first end of the plurality of individual strings, wherein the plurality of holders connected to the substantially planar surface are equidistantly located between the perimeter of the base and the center axis.

11. A kit for making knotted string accessories comprising:

a first base comprising:

a substantially planar surface with a perimeter and a center axis extending perpendicular to the planar surface; and a first plurality of holders connected to the substantially planar surface, each of the first plurality of holders located at a first distance from the center axis and configured to retain individual strings;

a first storage compartment movably attached to the first base; and a plurality of the individual strings.

12. The kit of claim 11, wherein the first plurality of holders is located proximate the perimeter of the first base and spaced equidistantly around the perimeter of the first base, the kit further comprising:

a second base comprising:

a substantially planar surface with a perimeter and a center axis extending perpendicular to the substantially planar surface;

an aperture through which the center axis extends and configured to receive a securing member configured to secure a first end of the plurality of individual strings; and a plurality of holders connected to the substantially planar surface located between the perimeter of the second base and the center axis, wherein the plurality of holders are configured to retain individual strings.

13. The kit of claim 12, wherein the second base is sized to overlay the first base within the plurality of holders of the first base.

14. The kit of claim 12 further comprising:

a lid configured to attach to the first storage compartment such that the first base and second base are enclosed within the lid and the first storage compartment.

15. The kit of claim 12, wherein the securing member is a ring, wherein the first end of the plurality of individual strings is attached to the ring.

16. The kit of claim 12, wherein the plurality of holders of the second base are a plurality of clips, each clip including a clip portion that is offset from the substantially planar surface.

17. The kit of claim 11 further comprising:

positioning members each configured to attach to an individual string and removably attached to the first base proximate to a respective one of the plurality of holders at a second distance from the center axis, the second distance greater than the first distance.

18. The kit of claim 11, wherein the holders of the first base are a plurality of raised portions extending outward from the substantially planar surface parallel to the center axis in close proximity to one another, wherein adjacent raised portions are configured to retain an individual string.

19. The kit of claim 11, further comprising:

a second storage compartment defining a cavity and configured to be removable attached to the first storage compartment.

20. The kit of claim 11, wherein the first base has a recessed portion within the substantially planar surface, the kit further comprising:

at least one pattern template configured to be received within the recessed portion of the first base.

21. A device for making knotted string accessories from a plurality of individual strings comprising:

a base having a substantially planar surface with a perimeter and a center axis extending perpendicular to the planar surface; and a plurality of holders connected to the substantially planar surface, each of the plurality of holders located at a first distance from the center axis, wherein the plurality of holders are a plurality of slits defined in the perimeter of the base, each slit configured to retain an individual string.

* * * * *